US005311857A

United States Patent [19]

Chang

[11] Patent Number: 5,311,857

[45] Date of Patent: May 17, 1994

[54] STRUCTURE SMOKE EXHAUSTER

[76] Inventor: Hsing-Wen Chang, Suite 1, 11 F, 95-8 Chang Ping Road, Sec. 1, Taichung, Taiwan

[21] Appl. No.: 900,200

[22] Filed: Jun. 17, 1992

[51] Int. Cl.[5] ..... F24C 15/20

[52] U.S. Cl. ..... 126/299 D

[58] Field of Search ..... 126/299 R, 299 D; 454/49, 67

[56] References Cited

U.S. PATENT DOCUMENTS

| | | | |
|---|---|---|---|
| 2,828,683 | 4/1958 | Joseph et al. | 126/299 D |
| 2,971,451 | 2/1961 | Feig | 126/299 D |
| 3,589,266 | 6/1971 | Hike et al. | 126/299 D |
| 4,976,753 | 12/1990 | Huang | 55/473 X |
| 5,027,790 | 7/1991 | Chern | 126/299 D X |
| 5,053,065 | 10/1941 | Garay et al. | 55/473 X |

*Primary Examiner*—Harold Joyce

[57] ABSTRACT

A smoke exhauster structure comprises an enclosure having a releasably secured lower hood plate and a releasably secured fan housing disposed therein. The hood plate has a pair of spring loaded pivoting catches provided on respective rear corner portions thereof and a pair of protruding tabs on the front edge thereof which overlap and abut a retaining rim provided under the front panel of the enclosure. Each pivoting catch engages a respective locking bar in a rear portion of the enclosure to releasably secure the hood thereunder. The fan housing which surrounds the exhaust fans of the exhauster is releasably secured to the underside of a top plate of the enclosure by a set of latches provided around the periphery thereof. Each latch has a pivoting buckle whose ends are connected to a spring loaded lever, each buckle engages a corresponding hook shaped securing appendage provided on the underside of the top plate.

2 Claims, 2 Drawing Sheets

STRUCTURE SMOKE EXHAUSTER

BACKGROUND OF THE PRESENT INVENTION

The present invention relates to a smoke exhauster and more particularly to an improved structure smoke exhauster having a quick releasable hood and fan housing that facilitates the rapid and thorough cleaning thereof.

In a conventional smoke exhauster structure, of the type usually found disposed over a stove or cooking range in a kitchen, the cleaning of the lower surfaces or hood thereof is usually an arduous and tiresome task requiring a user to stand on an elevated platform while scrubbing the surfaces with a detergent cleaner to remove the accumulated layers of oil and grime thereon. Further, though the lower surfaces of the hood are accessible the fan blades and interior of the fan housing which have the highest concentrations of oil and grime are usually out of reach, with the cleaning thereof necessitating the removal of the assemblies. As this normally requires the disengagement of a plurality of interrelated fasteners, posing what to many is a formidable task, the fans and housing thereof are often cleaned only infrequently if at all.

The smoke exhauster structure of the present invention overcomes these shortcomings of a conventional smoke exhauster by providing a smoke exhauster whose hood and fan housing therein can be quickly removed or re-installed for cleaning.

With the quick releasable hood removed, the cleaning thereof could commence at a more convenient location such as over a sink or wash basin where a user could comfortably and safely scrub both surfaces thereon clean using far more vigor than would be feasible if the hood were still in an overhead position. Similarly, the fan housing covering the fans and fan motors can be rapidly detached for thorough cleaning leaving the fans and blades thereon fully exposed.

SUMMARY OF THE PRESENT INVENTION

The present invention has as a main object to provide a smoke exhauster structure having a quick releasable lower hood and fan housing that can be rapidly detached for cleaning and re-installed without the need of extraneous tools.

In accordance therewith, a smoke exhauster structure is provided with a releasably secured lower hood and inner fan housing. The hood plate which has apertures formed thereon for the suction fans is secured under the enclosure of the exhauster by a pair of spring loaded pivoting catches provided on respective rear corner portions thereof. Each pivoting catch is engaged with a respective locking bar fixedly secured to the rear of the enclosure. The hood plate has a pair of protruding tabs on the front edge thereof which engage a retaining rim formed under the front panel of the enclosure, overlapping and abutting the upper portion thereof to support the front portion of the hood plate. After the removal of the hood plate, the fan housing which surrounds the fan rotors and vent of the exhauster can also be detached by releasing a set of latches provided around the periphery thereof. Each latch has a spring loaded actuating lever and a U-shaped buckle pivotably attached therewith that engages a corresponding hook shaped securing appendage fixed to the underside of the enclosure top.

For a more thorough understanding of the present invention a detailed description of a preferred exemplary embodiment is provided below along with accompanying drawings.

DETAILED DESCRIPTION OF THE PREFERRED EMBODIMENT

Figure 1:
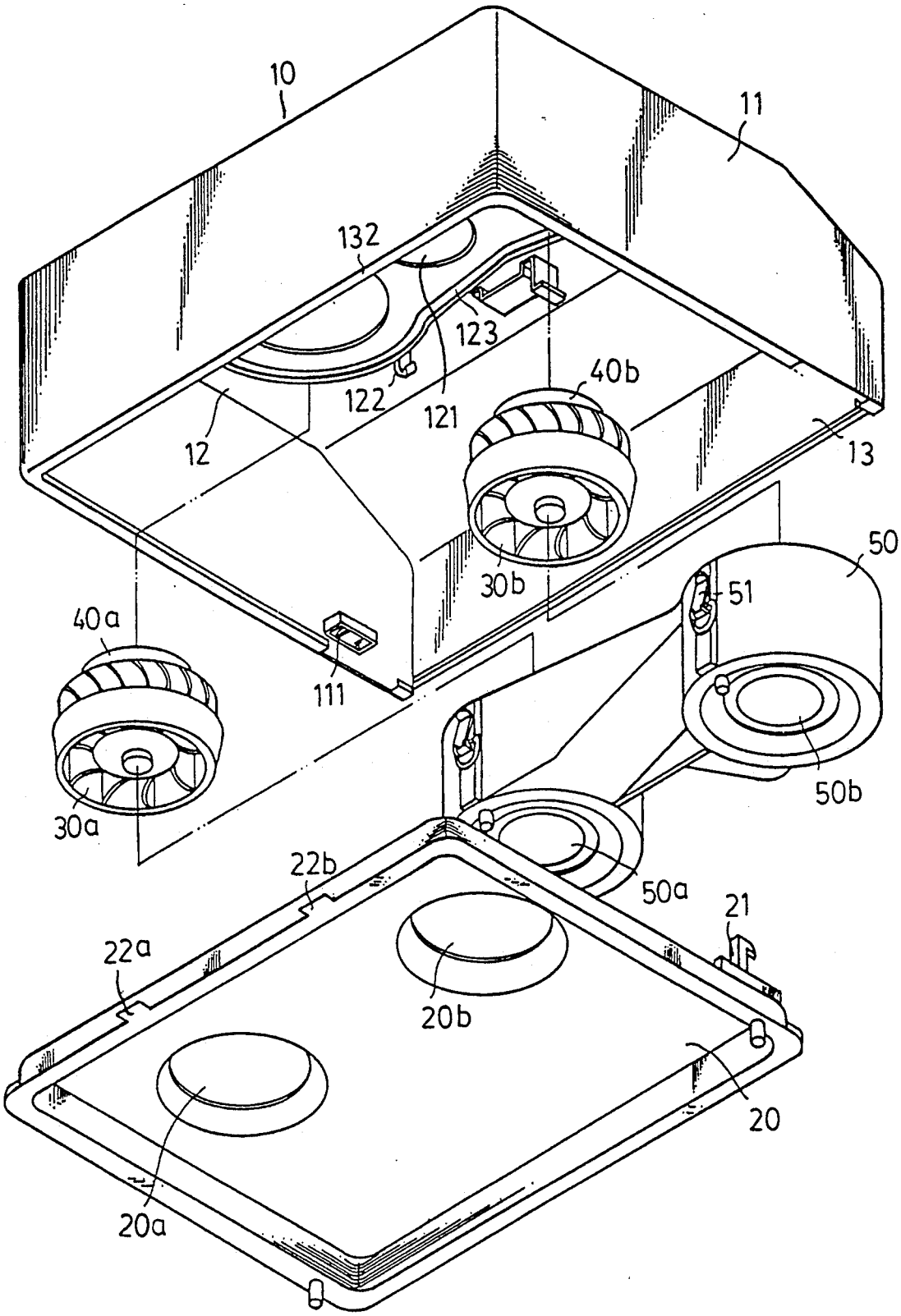
FIG. 1 is a perspective disassembled view of a preferred embodiment of the smoke exhauster of the present invention.

With reference to FIG. 1, a preferred embodiment of the smoke exhauster structure of the present invention comprises a generally rectangular enclosure 10 having a pair of lateral side plates 11, a top plate 12, and a front panel 13. A detachable lower hood plate 20 is releasably secured under enclosure 10 by a pair of pivoting catches 21 on respective corner portions thereof.

The concave hood plate 20 has a pair of circular apertures 20*a* and 20*b* formed therein through which a respective pair of centrifugal suction fans 30*a* and 30*b* are in communication with the space below the exhauster, which is normally positioned above a stove or cooking range.

The rotors of each fan, 30*a* and 30*b*, are engaged with the shafts of respective motors 40*a* and 40*b* disposed there above, which are in turn secured to the underside of top plate 12. A bank of control switches (not shown) on front panel 13 controls the actuation and operation of the motors and attached fans. A detachable fan housing 50 having roughly the shape of a figure-eight is releasably secured to the underside of top plate 12 by a set of four latches 51 provided around the upper peripheral rim thereof to define a surrounding cavity for fans 30*a* and 30*b*. Fan housing 50 has a pair of circular openings 50*a* and 50*b* formed on the lower portion thereof which have the same diameter as apertures, 20*a* and 20*b*, of hood plate 20 and are in respective registry therewith when the two are secured in the smoke exhauster. Air sucked into the cavity by the fans are directed towards a circular exhaust vent 121 formed centrally on top plate 12 for expulsion through an attached chimney (not shown).

When secured under enclosure 10, the pivoting catches 21 of hood plate 20 are respectively engaged with a pair of locking bars 111 fixedly secured to a rear portion of respective side plates 11. The front of the hood plate is supported by a pair of tabs 22*a* and 22*b* protruding from the front edge thereof which are engaged over a retaining rim 132 formed on the lower edge of a rear panel of the enclosure, with the tabs being overlapped and in abutment therewith.

Figure 2:
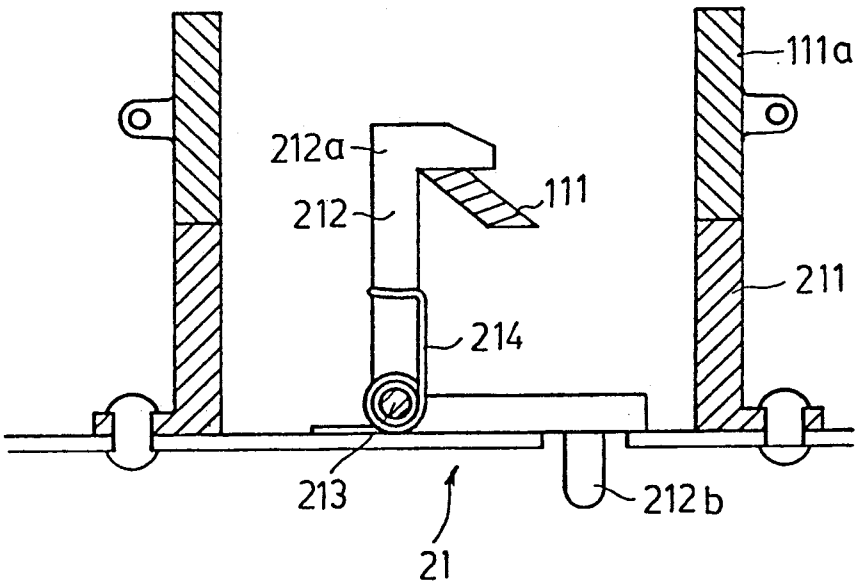
FIG. 2 is a side view of a sliding catch and locking protrusion of the smoke exhauster structure.

Referring to FIG. 2, each pivoting catch 21 includes a slotted rectangular holder 211 secured to the topside of the hood plate by rivets, and a generally angle-iron shaped pivot bar 212 pivotably secured within the holder by an axle pin 213 passing through the corner portion thereof. A torsion spring 214 disposed between holder 211 and the pivot bar biases the latter to rotate in a clockwise direction. The vertical arm of pivot bar 212 carries an L-shaped catch 212*a* formed on the terminal end thereof while the horizontal arm thereof has a release rod 212*b* formed thereon which protrudes downward through a slot formed in the hood plate.

Each locking bar 111 which is sloped with respect to a horizontal direction is disposed within a similar slotted rectangular holder 111*a* which is rivet secured to a respective side plate 11 at a predetermined position thereon so as to be in registry with a corresponding holder 211 on the hood plate when secured thereunder.

To secure the hood plate under the enclosure, tabs 22*a* and 22*b* on the front thereof are first positioned over retaining rim 132 so as to be in abutment therewith, the rear of the hood plate being then forced upwards so as to engage the pivoting catches 21 with corresponding locking bars 111 in the enclosure.

In so doing, a sloped upper cam surface on catch 212*a* would abut a sloped lower side of locking bar 111 and cause the rotation of pivot bar 211 in a counter-clockwise direction. After further vertical motion, catch 212*a* would clear the top of locking bar 111 and rotate in an opposite direction being urged by torsion spring 214. A leveled, lower abutment surface of catch 212*a* would then rest against an upper portion of the locking bar with the respective holders 211 and 111*a* having been brought into registry. Hood plate 20 is thus releasably secured to enclosure 10.

To release the hood plate, a user would push upwards on release rod 212*b* to cause the rotation of pivot bar 212 and effect the disengagement thereof from the corresponding locking bar 111.

Figure 3:
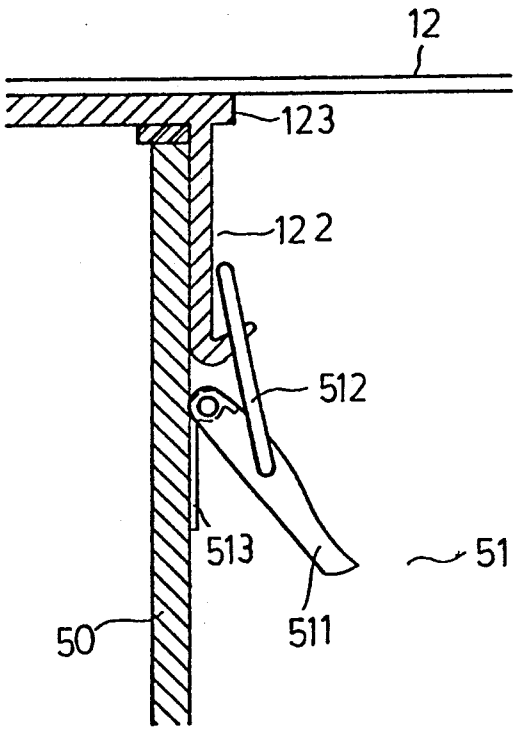
FIG. 3 is a side view of a latch and securing appendage of the smoke exhauster structure.

As shown in FIG. 3, each latch 51 on fan housing 50 includes a lever 511 pivotably secured on one end thereof to the outer periphery of the fan housing, and a generally U-shaped buckle 512 with the open ends thereof pivotably attached to the lever at a central position thereon. A torsional spring 513 urges lever 511 to rotate downwards away from the top plate. Each latch 51 engages a corresponding hook-shaped securing appendage 122 protruding downward from the underside of the top plate 12 to releasably secure the fan housing thereunder, the buckle 512 thereof being looped over the securing appendage and brought down thereagainst by rotating the lever 511 against the periphery of the housing to effect the securement.

Securing appendages 122 are formed integrally with a generally figure-eight shaped sealing flange 123 attached to the underside of the top plate that carries an elastic seal around the inner periphery thereof, serving to position the fan housing and prevent the leakage of air through the upper portion thereof.

Aside from the specificities of the aforementioned exemplary embodiment, numerous variations or modifications to the present invention could be made by a person of ordinary skill in the art without departing from the spirit or scope thereof, which as such should not be determined from the limitations of the prior exposition but from the appended claims and their legal equivalents.

I claim:

1. A structure of a smoke exhauster comprising:

an enclosure having a top plate, a pair of lateral side plates, and a front panel;

an exhaust vent passing through a central portion of said top plate;

at least one motor secured under said top plate;

at least one suction fan, each said at least one suction fan being coupled to the shaft of a corresponding said at least one motor and disposed thereunder;

a fan housing disposed within said enclosure and surrounding each said at least one suction fan and said exhaust vent, said fan housing having at least one first circular aperture formed thereon, each said at least one first circular aperture being positioned below the fan rotor of a corresponding said at least one suction fan;

a first releasable securing means for attaching said fan housing to the underside of said top plate;

a concave lower hood plate disposed under said enclosure, said hood plate having at least one second circular aperture formed thereon, each said second circular aperture being positioned under a corresponding said at least one first circular aperture in registry therewith and having substantially equal diameter;

a second releasable securing means for attaching said hood plate under said enclosure;

a pair or roughly angle iron shaped pivoting bars pivotably mounted above said hood plate about respective corner portions thereof, each said pivoting bars having a release rod protruding downward from a horizontal arm thereof through a corresponding slot on said hood plate;

a generally L shaped catch formed on the end portion of a vertical arm of each said pivoting bar, having a sloped upper cam surface and a substantially level lower abutment surface;

a torsion spring biasing each said pivoting bar in a predetermined rotational direction;

a pair of sloped locking bars fixedly secured at predetermined positions in a rear portion of said enclosure for engaging corresponding said pivoting bars;

wherein, when the rear portion of said hood plate is raised upwards in said enclosure, each said locking bars engages said cam surface of a corresponding said catch, causing the rotation of said pivoting bar against said spring, said spring subsequently causing said pivoting bar to rotate in an opposite direction so that each said locking bars engages said abutment surface of a corresponding said catch.

2. A structure of a smoke exhauster according to claim 1, wherein said first releasably securing means comprises;

a set of levers pivotably secured to the outer periphery of said fan housing at predetermined positions thereon near the upper rim thereof;

a torsion spring biasing each said lever downwards away from said top plate;

a generally U shaped buckle on each said lever with the free ends thereof pivotably secured to a corresponding said lever at a medial position thereon;

a set of roughly hook shaped securing appendages fixed to the underside of said top plate of said enclosure at predetermined positions thereon;

wherein, each said lever can be rotated away from said fan housing and said buckle thereon looped over a corresponding said securing appendage, rotating said lever downwards away from said top plate engages said buckle with said securing appendage to effect securement between said fan housing and said top plate of said enclosure.

* * * * *